United States Patent [19]

Rector et al.

[11] Patent Number: 4,661,808

[45] Date of Patent: Apr. 28, 1987

[54] VARIABLE FONT DISPLAY

[75] Inventors: Robert E. Rector, Richardson; Larry T. Taylor, Plano; Richard J. Grassi, Royse City, all of Tex.

[73] Assignee: Gulton Industries, Inc., Metuchen, N.J.

[21] Appl. No.: 696,896

[22] Filed: Jan. 31, 1985

Related U.S. Application Data

[63] Continuation of Ser. No. 656,095, Sep. 28, 1984, abandoned.

[51] Int. Cl.[4] ..... G09G 3/20

[52] U.S. Cl. ..... 340/735; 340/790; 340/789

[58] Field of Search ..... 340/723, 724, 735, 731, 340/752, 792, 790

[56] References Cited

U.S. PATENT DOCUMENTS

| | | | |
|---|---|---|---|
| 3,267,454 | 8/1966 | Schaaf | 340/724 |
| 3,274,909 | 9/1966 | Hauenbach | 340/723 |
| 3,918,040 | 11/1975 | Beuter et al. | 340/724 |
| 4,153,940 | 5/1979 | Grier et al. | 340/724 |
| 4,193,071 | 3/1980 | Hasegawa et al. | 340/723 |
| 4,216,471 | 8/1980 | Akred, Sr. | 340/756 |
| 4,246,578 | 1/1981 | Kawasaki et al. | 340/750 |
| 4,316,188 | 2/1982 | Cancasci, Jr. | 340/735 |
| 4,342,096 | 7/1982 | McDevitt | 340/731 |
| 4,586,835 | 5/1986 | Alexander et al. | 340/735 |
| 4,613,856 | 9/1986 | Olin et al. | 340/735 |

*Primary Examiner*—Gerald L. Brigance
*Attorney, Agent, or Firm*—Darby & Darby

[57] ABSTRACT

In a display where all characters are displayed in equal sized spaces, such as a bus or vehicle sign, for example, the problem of characters appearing to merge from a distance is remedied. The spacing between characters is automatically adjusted in accordance with both the characteristics of the particular character representations displayed and their sequence within the display.

32 Claims, 5 Drawing Figures

FIG. 1
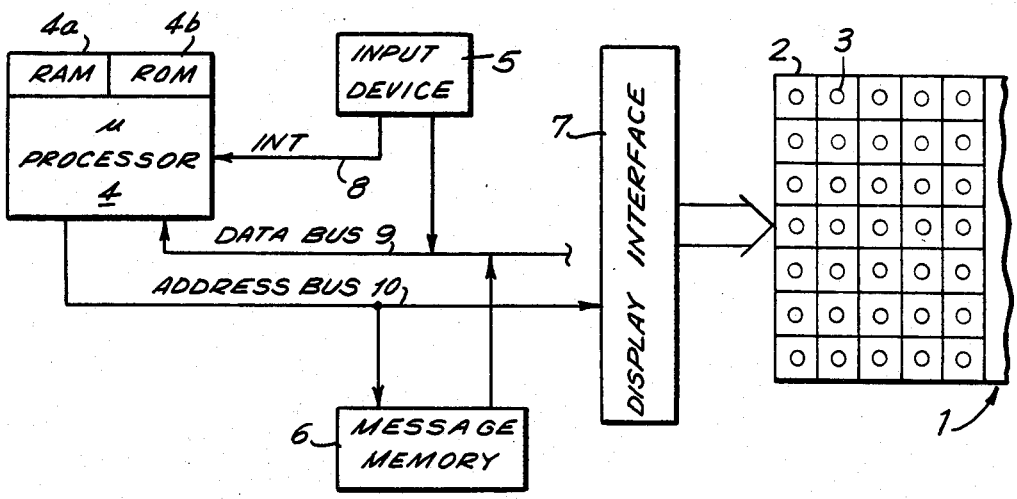
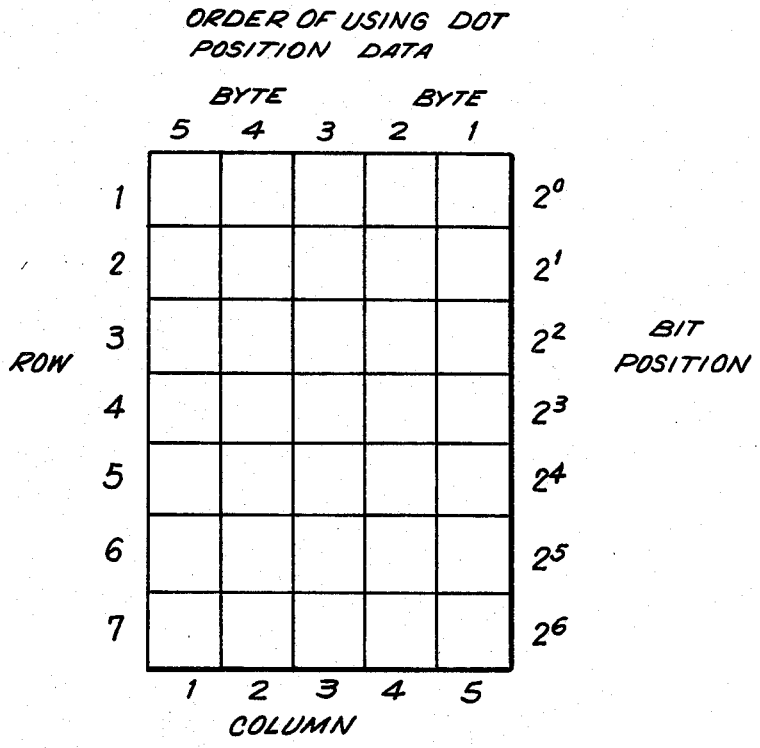
FIG. 2

VARIABLE FONT DISPLAY

This is a continuation of application Ser. No. 656,095, filed Sept. 28, 1984 now abandoned.

BACKGROUND OF THE INVENTION

This invention relates to a method and apparatus for controlling the spacing between letters and other characters in a display system. In an illustrative embodiment, the invention is utilized in a display system in which characters are displayed by matrices of display elements. In a more general sense, however, the invention is applicable to any system capable of forming characters or fonts having character representations of varying width (e.g. ink jet printers).

Practical display systems employing elements such as light-emitting diodes, rotatable or "flippable" dots, or other types of display elements capable of being arranged in matrices or arrays for the forming of letters or symbols have been used for many years. Display panels including a large number of such arrays or display units are commercially available. One such system, for example, is described in U.S. Pat. No. 4,216,471.

A particularly advantageous use of such display systems is for the display of destinations of moving vehicles such as buses. Typically, such systems incorporate a plurality of display units in one or more lines, each unit of which includes a plurality of flip dots arranged in a seven-high by five-wide array or matrix (with seven rows and five columns of display elements). Each of these matrices forms a fixed-size "character display space" capable of displaying one character or symbol. For a bus destination sign, there is a constraint on the total length of the sign due to the structure of the cavity in which the sign is installed. In addition, each line of the sign must be capable of displaying a number of characters sufficient to describe most destinations, usually at least approximately 15 characters).

It is desirable to make the height of each character as great as possible, within space limitations, in order to increase legibility at a distance. However, as character height is increased, the spacing between characters must be increased to prevent the characters from seeming to run together as the distance between the observer and the sign increases.

In one typical scheme for displaying the characters on such a display system, the depiction of each character uses the entire "character display space" occupied by a 5×7 array of display elements. Such a sign can be difficult to read at a distance when adjacent characters are of a "block type", (e.g. M, A, N, H or A), because these characters appear to the eye to merge together at a distance. In this system, the only way to increase the spacing between characters is to increase the separation between "character display spaces" (here the physical space between each pair of 5×7 arrays). Unfortunately, in view of the limited total space available, this solution can reduce the number of character spaces and hence the maximum number of characters which may be displayed in one line of text.

In another prior system, only four out of the available five columns of each array are utilized for displaying each character, except for some characters which require all five columns (e.g. M, T, V, W, X). The characters which are four columns wide are all right-shifted in their respective character spaces (5×7 arrays) leaving the leftmost columns of the array vacant.

Display systems such as those described above include an operator control panel, a microprocessor, and a message memory such as a Programmable Read Only Memory (PROM) or an Eraseable Programmable Read Only Memory (EPROM). The message memory contains all of the possible messages which may be displayed by the system, with their characters usually coded in ASCII format. Utilizing the operator control panel, the operator may specify which of these messages is to be displayed. The ASCII data defining the characters of this message is then successively read into the microprocessor where each ASCII-encoded character is translated into signals for actuating the display elements to provide a corresponding display representation of the character (e.g. a pattern of dots for forming the corresponding character in the appropriate character space).

SUMMARY OF THE INVENTION

The present invention provides means in systems of this type for ameliorating the problem of characters appearing to merge together at a distance. In accordance with the invention, the spacing between display character representations is automatically adjusted in accordance with both the characteristics of the particular character representations displayed in a line of text, and their sequence within the line. This is done by modifying the ASCII codes for certain of the characters, to provide modified codes which in turn provide modified displays of the characters. In effect, the present invention sets up several (e.g. three) fonts of characters. In each message line each individual character is selected from one of these fonts, in accordance with a scheme described below, to enhance legibility. The selection is done by examining the original characters as stored in ASCII code in an original data base in the message memory, and creating a new data base in which each character is stored in a code corresponding to one of the several character fonts. The new data base may either replace the original one, or be separately stored in its own memory section. The new data base incorporates the data required to produce a display of the characters of each message line with improved legibility, by appropriately determiing the spacing between displayed characters.

This variable spacing ability is provided in the following manner. All displayable characters are classified in terms of the amount of space they require for display. For example, one group of "wide" characters must always be displayed using a representation of the maximum width i.e., a representation which uses the entire width (e.g. five columns) of a character display space. Other groups of characters may be displayed using narrower character representations (e.g. four or three columns).

For example, in the illustrative embodiment set forth below, 7 row×5 column display arrays are employed, each array constituting a character space. Letters such as M, V, W, X, Y, and Z are classified as "wide" characters because all five columns of the character space are always used to display these characters. "Narrow" characters whose display reprsentations may utilize three or less columns include, for example, the symbols ? and %, a blank space and the numeral 1. These and certain other characters are called "delimiter characters" as explained below. Other characters may utilize either four or five columns depending on the relationship of their positions to those of other characters in the line.

According to the invention, the first step is to locate "blocks" of characters in the full display line which are formed using either 4 or 5 columns and are separated by "delimeter" characters, which are generally formed using three columns or less of their respective display arrays. As will be described in greater detail below, the characters "J", "L" and "T" may also be used as delimiter characters. Thus each "character block" is determined as those characters of a message line which occur between two delimiter characters.

For each such character block, a primary character is selected from the characters in the block. This is generally the leftmost character which must be formed using its entire character space (i.e. M, N, V, W, X, Y or Z using 5 columns in the illustrative embodiment). If the character block contains none of these wide characters, then another character is selected as the primary character, to be displayed using 5 columns, according to a predetermined priority scheme. All of the characters in the block to the left of the primary character are caused to be displayed using character representations of intermediate width (four columns) and are made left-adjusted (i.e. shifted to the left) in their respective character spaces at the time of display. All of the characters to the right of the primary character which are identified to be formed using intermediate-width character representations are made to be right-adjusted (i.e. shifted to the right) in their respective character spaces. "Narrow" and delimiter characters (e.g. lower case letters and a number of special symbols) are always centered as much as possible within their respective character spaces.

According to one aspect of the illustrative embodiment, the present invention may be deemed to set up three separate fonts of characters. One font uses a standard ASCII code for the characters, usually displayed in all five columns. A second font uses a modified ASCII code to designate that the characters are shifted where necessary to match the left edge of their character display spaces and are four columns wide. The third font uses a differently modified ASCII code to designate that the characters are four columns wide and shifted where necessary to match the right edge of their character display spaces.

In accordance with the present invention, modified ASCII codes are used to identify the font from which a character representation for display is selected. In standard ASCII code, there is a unique code corresponding to each character. For example, the bits making up the ASCII code for the letter "L" are "01001100" binary ("4C" hexidecimal). In accordance with the present invention, this code may, for example, call for a representation of the letter "L" taken from a font in which the letter "L" utilizes full character display space. Another code is assigned to an "L" in a font where the "L" representation is of intermediate width and left-adjusted in its display space. A third code may be assigned to a font where the "L" representation is right-adjusted in its display space. Each message (e.g. destination) line is normally stored initially in ASCII code. By one aspect of the present invention, each character of each such message line is individually either left unchanged, or is converted to a code which is in one of the modified fonts, to constitute a new data base.

In accordance with the invention, the entire line of each message is stored in these modified codes so that when each encoded character is read out to be displayed in its message line, it carries with it information as to the font from which its display representation should be drawn. In one embodiment, data defining the character representations, each in its designated font, are stored in a Read-Only Memory. Each ASCII or modified ASCII code in this ROM provides corresponding character representation data. This data is read from the ROM and fed to a display interface which responds to the information by activating the appropriate display elements of respective arrays to display the desired characters correctly positioned within their respective character spaces in accordance with the above description.

In the illustrative embodiment described below, the analysis of message lines to determine proper character spacing, and the storage of the messages in modified ASCII code are performed by a computer program which is executed by a computer separate from the display apparatus. This program creates a data base including all of the messages displayable by the display apparatus, with each character in ASCII or modified ASCII code. This data base is then stored in a programmable read-only memory which stores the repertoire of messages for the display apparatus. According to one aspect of the invention, this memory is used to create signals for producing the desired display, in essentially the same manner as that in which the original ASCIII-encoded messages were used in the prior LIDS-4 system mentioned below.

Alternatively, however, the display system may use the original ASCII-encoded data base as the source for the desired message to be displayed, and the program of the present invention for converting the conventionally encoded (e.g. ASCII) messages to messages encoded to include display font information (e.g. modified ASCII) may be executed by the microprocessor of the display apparatus itself during operation of the apparatus. In effect, the microprocessor then converts each ASCII character to the modified ASCII code, for actuating the display to display the character in its appropriate font.

BRIEF DESCRIPTION OF THE DRAWINGS

The invention may be more clearly understood from the accompanying drawings in which:

FIG. 1 is a schematic block digram of a display system used in connection with an illustrative embodiment of the invention;

FIG. 2 is a pictorial representation of a display array showing the relationship between the display elements of the array to the data stored in a decoder table;

DESCRIPTION OF AN ILLUSTRATIVE EMBODIMENT

Figure 3A:
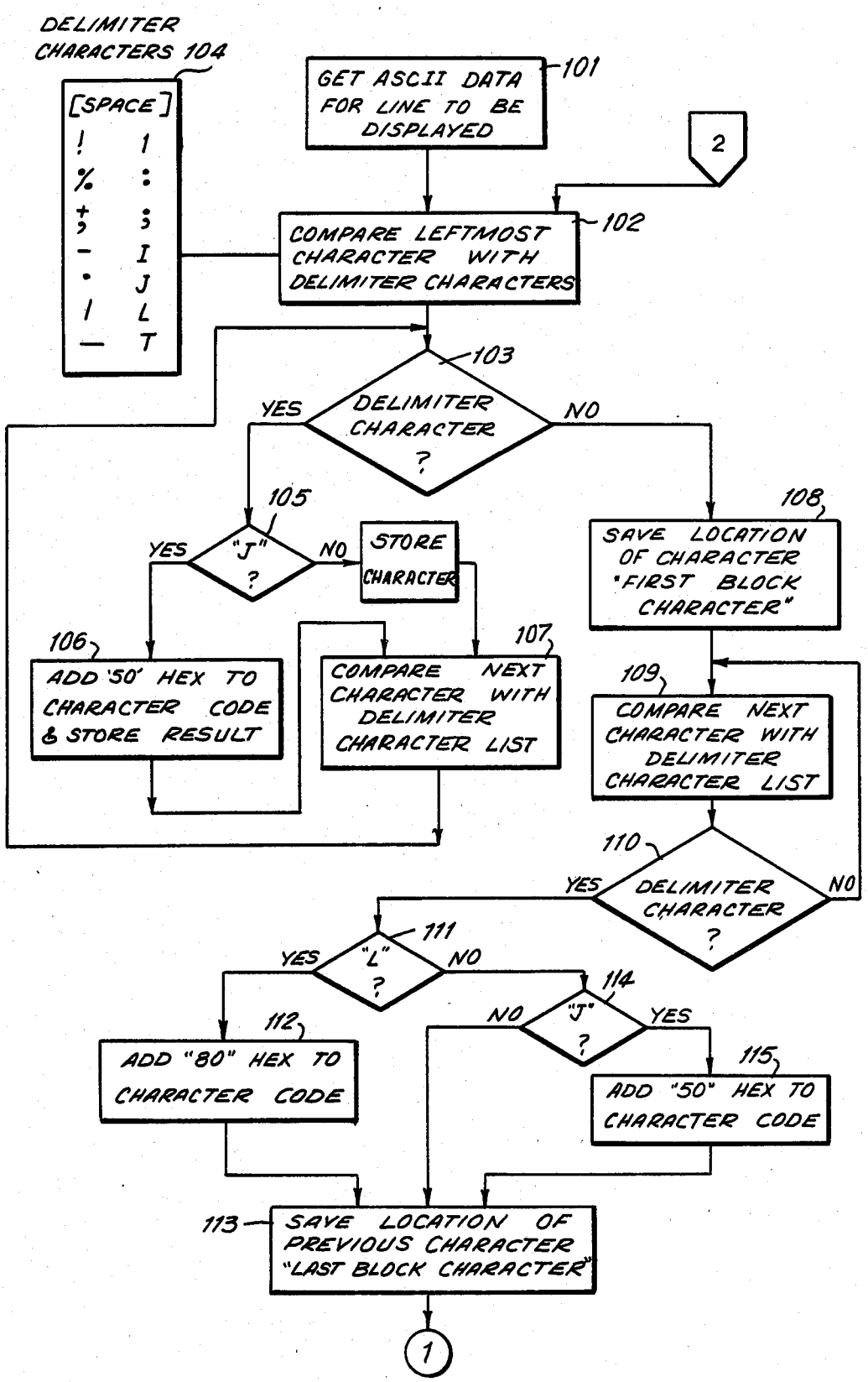
FIG. 3A is a portion of a simplified flow chart of programming means for performing operations in accordance with the present invention.

Referring to FIG. 1, there is shown a schematic block diagram of a display system to which the present invention may be applied. Such systems are commercially available. An example of such a system is the LIDS-4 Luminator Information and Display System manufactured by Gulton Industries., Inc., Luminator Division, Plano, TX.

The system includes a display sign 1 made up of a plurality of character display spaces implemented as a line of individual display arrays or modules, one of which is shown at 2. The display arrays are arranged in a side-by-side manner to form one or more lines of arrays capable of displaying respective lines of a message. Each array illustratively includes thirty-five display elements 3 arranged in five columns and seven rows. The system also includes a microprocessor 4, an input device 5, a message memory 6 and a display interface 7. Associated with the microprocessor 4 is a random access memory (RAM) 4*a* and a read-only memory (ROM) 4*b*. The read-only memory 4*b* of the microprocessor 4 contains the control program for the system. The RAM 4*a* of the microprocessor 4 is used for storing data inputted to the microprocessor 4 from other parts of the system and to store intermediate results produced by the microprocessor 4 during the execution of its control program. The input device 5 communicates with the microprocessor 4 by means of an interrupt signal path 8 over which the input device 5 may signal the microprocessor 4 that it has data to provide. The input device 5 may send data to the microprocessor via a data bus 9. The message memory 6 communicates with the microprocessor 4 via the data bus 9 and also via an address bus 10 over which the microprocessor 4 can send address information to the message memory 6. The address bus 10 also provides a path via which the microprocessor 4 can send signals to the display sign 1 via the display interface 7.

In the LIDS-4 system, the message memory 6 is an erasable programmable read only memory (EPROM) which is usually personalized at the factory to include all of the messages which are desired to be displayed in a particular system, the messages being encoded in ASCII format. In adapting this system to the present invention, the encoding for individual characters may be in ASCII or modified ASCII format. The input device 5 of the LIDS-4 system is a selector (e.g., a switch) which gives an operator the capability of selecting one of a plurality of numbers. Each of these numbers corresponds to a respective message stored in the message memory 6.

When an operator wishes to change the message display, he operates the input device 5 to select a new message number. ASCII data representing this new message number are transmitted to the microprocessor 4 via data bus 9. In response to this transmission, the microprocessor 4 transmits address data corresponding to this new message to the message memory 6 via the address bus 10. The message memory 6 responds by transmitting the newly selected message to the microprocessor 4 in ASCII or modified ASCII format via the data bus 9. The microprocessor 4 then decodes this encoded message to a format suitable for operating the display arrays to the message sign 1. Signals in this format are communicated to the display interface 7 over the address bus 10. The display interface 7, in turn, converts the signals from the address but 10 into signals capable of operating the individual display elements 3 of the display sign 1, so as to display the characters derived from the memory.

TABLE I

| | | | | | ASCII Character Codes | | | | | | | |
|---|---|---|---|---|---|---|---|---|---|---|---|---|
| | | | | b7 → | 0 | 0 | 0 | 0 | 1 | 1 | 1 | 1 |
| | | | | b6 → | 0 | 0 | 1 | 1 | 0 | 0 | 1 | 1 |
| | | | | b5 → | 0 | 1 | 0 | 1 | 0 | 1 | 0 | 1 |
| | | | | | Column | | | | | | | |
| b4 | b3 | b2 | b1 | Row | 0 | 1 | 2 | 3 | 4 | 5 | 6 | 7 |
| 0 | 0 | 0 | 0 | 0 | NUL | DLE | SP | 0 | @ | P | ' | P |
| 0 | 0 | 0 | 1 | 1 | SOH | DC1 | \| | 1 | A | Q | a | q |
| 0 | 0 | 1 | 0 | 2 | STX | DC2 | " | 2 | B | R | b | r |
| 0 | 0 | 1 | 1 | 3 | ETX | DC3 | # | 3 | C | S | c | s |
| 0 | 1 | 0 | 0 | 4 | EOT | DC4 | $ | 4 | D | T | d | t |
| 0 | 1 | 0 | 1 | 5 | ENQ | NAK | % | 5 | E | U | e | u |
| 0 | 1 | 1 | 0 | 6 | ACK | SYN | & | 6 | F | V | f | v |
| 0 | 1 | 1 | 1 | 7 | BEL | ETB | ' | 7 | G | W | g | w |
| 1 | 0 | 0 | 0 | 8 | BS | CAN | ( | 8 | H | X | h | x |
| 1 | 0 | 0 | 1 | 9 | HT | EM | ) | 9 | I | Y | i | y |
| 1 | 0 | 1 | 0 | 10 | LF | SUB | * | : | J | Z | j | z |
| 1 | 0 | 1 | 1 | 11 | VT | ESC | + | : | K | [ | k | l |
| 1 | 1 | 0 | 0 | 12 | FF | FS | , | < | L | \ | l | : |
| 1 | 1 | 0 | 1 | 13 | CR | GS | – | = | M | ] | m | l |
| 1 | 1 | 1 | 0 | 14 | SO | RS | . | > | N | Λ | n | ~ |
| 1 | 1 | 1 | 1 | 15 | SI | US | / | ? | O | — | o | DEL |

NUL Null
SOH Start of heading
STX Start of text
ETX End of text
EOT End of transmission
ENQ Enquiry
ACK Acknowledge
BEL Bell, or alarm
BS Backspace
HT Horizontal tabulation
LF Line feed
VT Vertical tabulation
FF Form feed
CR Carriage-return
SO Shift out
SI Shift in
DLE Data link escape
DC1 Device control 1
DC2 Device control 2
DC3 Device control 3
DC4 Device control 4
NAK Negative acknowledge
SYN Synchronous idle
ETB End of transmission block
CAN Cancel
EM End of medium
SUB Substitute
ESC Escape
FS File separator
GS Group separator
RS Record separator
US Unit separator
SP Space
DEL Delete As can be noted from Table 1 above, ASCII (American Standard Code for Information Interchange), is a code which utilizes 7 binary digits or bits for each character. Since each display module 2 contains 35 displays elements 3, 35 binary digits of information are required to operate each display module to display a character. A typical manner in which ASCII-endoded data may be converted to a format suitable for operating a message display sign is by utilizing a decoding table (stored for example in the ROM 4*b*) in which the ASCII code for each character is associated with 5 bytes of data. Since each byte contains 8 bits, these 5 bytes are capable of providing 40 bits of information and 5 of these bits, or 1 bit per byte, are not needed.

FIG. 2 illustrates the manner in which the bits of information in these 5 bytes of data may be utilized to define the "on" or "off" states of the individual display elements 3 of a display module 2. The data in bytes 1 through 5 are used respectively to determine the on or off status of the display elements in columns 5 through 1. It will be noted that the highest-order bit position ($2^7$) of each of the 5 bytes is not used in this embodiment.

It will be apparent that it is not necessary for the input device 5 to be a merely numerical device. The input device could, for example, be a keyboard capable of inputting any desired message into the microprocessor 4. In such an embodiment, the message memory 6 is not necessarily implemented as a separate EPROM and may, in fact be implemented as a RAM. It could, for example, be incorporated as part of the microprocessor RAM 4*a*.

As will be noted from Table 1, the encoding of each character defined in the ASCII scheme utilizes only 7 of the 8 bits available for such purposes. The present invention utilizes this unused bit to represent information regarding the width of the character representation to be displayed and the positioning of this representation within its respective character display space. For example, the ASCII representation of the letter "L" is '4C' hexidecimal ('01001100' binary). In accordance with the present invention, this code may, for example, represent a display representation of the letter "L" in a font in which all 5 columns of an array 3 of the display system as shown in FIG. 1 are utilized. Alternative modified ASCII codings of the letter "L" may for example signify a display representation of the character in which only four columns are used and the character is shifted left or right in its display array. Table 2 below sets forth the alternative modified ASCII codings (in hexidecimal) utilized in the illustrative embodiment of the invention discussed below.

In the illustrative embodiment of the invention an entry containing data defining an appropriate display representation is provided in the decoding table of the microprocessor 4 corresponding to each ASCII or modified ASCII coding so as to be able to provide the respective bit pattern to the display sign 3. It is not necessary, however, that data for the display repreentations in the table corresponding to each alternative ASCII or modified ASCII coding of a particular character be unique. That is, for a given character the display representation data in the decoding table may be the same for as many alternate ASCII or modified ASCII codings as desired. In the illustrative embodiment, for example, the display representation data for "wide" characters contained in the decoder table is the same (five-column wide) for all alternative ASCII and modified ASCII codings of these characters.

The invention is equally applicable to other systems in which means are provided for displaying characters of various widths or fonts. Examples of such systems are systems in which the characters are displayed by a wire matrix printer, by electronics means (e.g. by a CRT), by means of an ink jet, or by means of a laser.

The following description of an illustrative program for carrying out the operations for the present invention is illustrated by the program flow chart of FIG. 3. In the illustrative embodiment, this program is executed on a computer separate from the microprocessor 4 of the display system of FIG. 1 to produce a ROM to be used in place of memory 6. The program analyzes an ADCII-encoded data base including all of the messages desired to be displayed by a particular system. As a result of this analysis, it constructs a new data base encoded in the modified ASCII codes of Table 2 which includes information as to the widths of character representations to be used in a display of each message and the position of each character representation within its respective character space upon being displayed.

As set forth in Table 2 the standard ASCII encodings (first column) of each character are used to denote display representations of these characters in which, for example, the characters are displayed using all five columns of their respective character spaces. Another group of encodings denotes display representations of characters in a font in which at least some characters are displayed right adjusted or shifted using only four of the available five columns of the display space. The particular code used for each character in this alternative coding is obtained by adding a hexidecimal '50' to the hexidecimal equivalent of the standard ASCII code for the respective character. The result of this addition is always a hexidecimal number greater than or equal to '80' hex, since ASCII codes having hex equivalents lower than hex '30' are not used for character representation (See Table 1). Moreover, standard ASCII has no codes having hexidecmal equivalents of greater than '80'. Thus all hex values greater than '80' may be used for the purpose of providing alternate character codes for modified fonts.

As shown in Table 2 the result of adding hex '50' to the hex equivalents of the ASCII codes for the characters 0 through 9 and A through Z is a group of hex numbers ranging from '80' to "AA". This group of numbers may comprise the modified ASCII coding for a four-column left-adjusted font.

Similiarly the hexidecimal value '80' may be added to the standard ASCII hexidecimal equivalents of the above characters. These additions result in a group of hexidecimal numbers ranging from 'B0' through 'DA' which in the illustrative embodiment are used to denote character display representations in a four-column right-adjusted font.

It is apparent from the above that by selecting appropriate encoding for each character in a message from the alternatives in Table 2, messages from the original data base can be encoded to carry position and size data for each character. Messages so encoded may be stored in a second data base. This second data base may be stored in an EPROM which is incorporated with each system to constitute the message memory 6 prior to shipment of the system from the factory.

TABLE 2

MODIFIED ASCII CODE REPRESENTATIONS (IN HEXIDECIMAL)

| Character | Five-column font (Standard ASCII) | Four-column left shifted font | Four-column right shifted font |
|---|---|---|---|
| 0 | 30 | 80 | B0 |
| 1 | 31 | 81 | B1 |
| 2 | 32 | 82 | B2 |
| 3 | 33 | 83 | B3 |
| 4 | 34 | 84 | B4 |
| 5 | 35 | 85 | B5 |
| 6 | 36 | 86 | B6 |
| 7 | 37 | 87 | B7 |
| 8 | 38 | 88 | B8 |
| 9 | 39 | 89 | B9 |
| A | 41 | 91 | C1 |
| B | 42 | 92 | C2 |
| C | 43 | 93 | C3 |
| D | 44 | 94 | C4 |
| E | 45 | 95 | C5 |
| F | 46 | 96 | C6 |
| G | 47 | 97 | C7 |
| H | 48 | 98 | C8 |
| I | 49 | 99 | C9 |
| J | 4A | 9A | CA |

TABLE 2-continued

MODIFIED ASCII CODE REPRESENTATIONS (IN HEXIDECIMAL)

| Character | Five-column font (Standard ASCII) | Four-column left shifted font | Four-column right shifted font |
|---|---|---|---|
| K | 4B | 9B | CB |
| L | 4C | 9C | CC |
| M | 4D | 9D | CD |
| N | 4E | 9E | CE |
| O | 4F | 9F | CF |
| P | 50 | A0 | D0 |
| Q | 51 | A1 | D1 |
| R | 52 | A2 | D2 |
| S | 53 | A3 | D3 |
| T | 54 | A4 | D4 |
| U | 55 | A5 | D5 |
| V | 56 | A6 | D6 |
| W | 57 | A7 | D7 |
| X | 58 | A8 | D8 |
| Y | 59 | A9 | D9 |
| Z | 5A | AA | DA |

While three separate fonts are thus set up in Table 2, it will be understood that they are not utilized independently of one another. Rather, each message is formed of character representations which may be selected from various of these fonts, in the manner set out below.

Figure 3B:
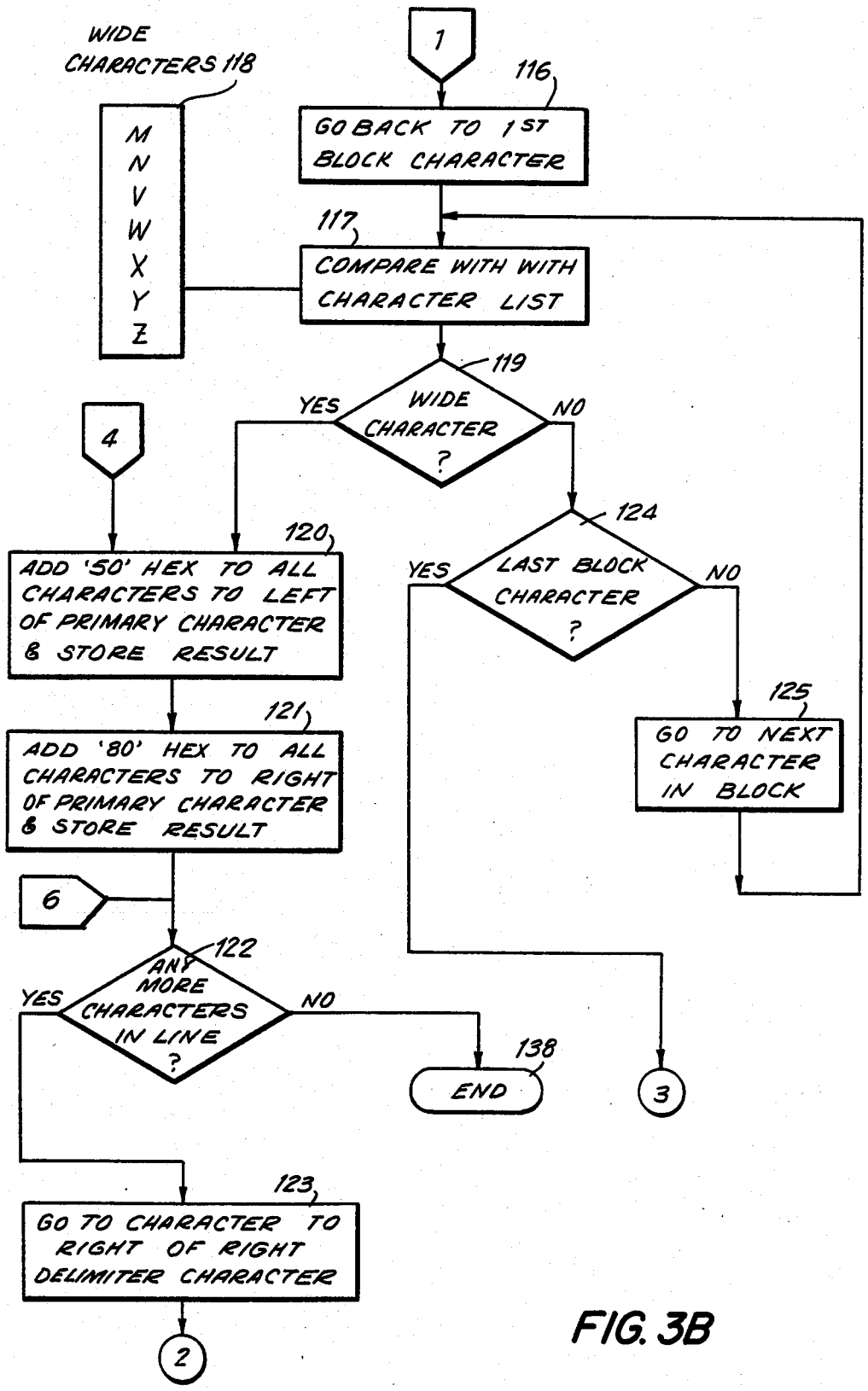
FIG. 3B is another portion of the simplified flow chart of FIG. 3A.
Figure 3C:
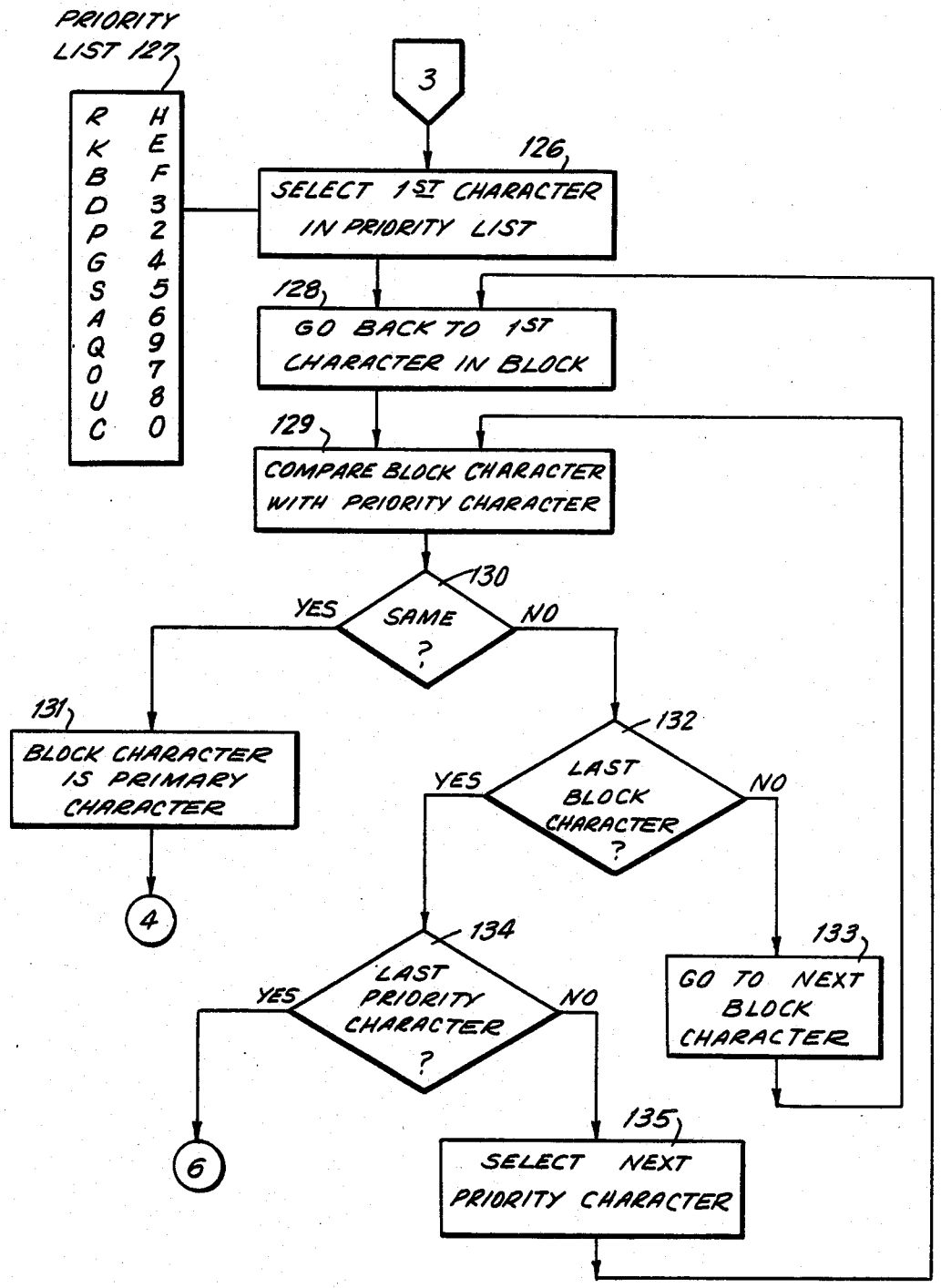
FIG. 3C is still another portion of the simplified flow chart of FIG. 3A.

FIGS. 3A, 3B and 3C taken together are a flow chart indicating the successive steps to be taken in carrying out the present invention, to convert an ASCII-encoded message into a modified-ASII-encoded message according to the invention. Each box or diamond indicates a series of program steps to accomplish the operation indicated in the box.

Referring to FIG. 3A, box 101, the program first obtains the ASCII-encoded data corresponding to a first line of characters to be displayed (corresponding to a message line), from the ASCII data base in message memory 6 containing the message repetoire desired for a particular system. In box 102, the system compares the left-most character of this line with a group of characters which are defined as "delimiter characters". With some exceptions as will be noted below, these delimiter characters are displayed utilizing three or fewer columns of their respective arrays and are centered within their arrays at the time of display. The characters which are defined as delimiter characters in the illustrative embodiment are listed in box 104 of FIG. 3A.

In diamond 103, a decision is made as to whether that left-most character is a delimiter character. If it is, diamond 105 is entered where a decision is made as to whether that character is the letter "J". If the character is a "J", a hexidecimal '50' is added to the hexidecimal representation of a "J" in ASCII code ('4A') and the result of this addition (hexidecimal '9A') is stored in a second data base as an alternative representation of the character "J" in the selected first line of characters. Referring to Table 2 it will be noted that this alternative representation of the letter "J" is in the font for displaying this character shifted to the left using four columns.

From box 106 the program proceeds to box 107 where the ASCII code of the next character in the message line is compared with the ASCII codes of the delimiter characters. From box 107, the program loops back to the diamond 103 and repeats the steps of boxes 103, 105 and 106.

If in decision diamond 105, it is determined that the character being analyzed is not a "J", the program proceeds directly to box 107 without performing the operations called for in box 106, and then returns to diamond 103. Returning to diamond 103, if the character under analysis is not a delimiter character, the program proceeds to box 108. In box 108, the memory location of this character (which is defined or identified as the "first block character") is saved for future reference. The effect of the procedure up to this point is to locate the first character of the message which is not a delimiter character.

The program then proceeds to box 109 where the next sequential character in the message line is compared with the list of delimiter characters. Decision diamond 110 is then entered. If the character in question is not a delimiter character, the program loops back to box 109 and proceeds with the following sequential characters in the message line. If, on the other hand, the character under analysis is a delimiter character, it is defined or identified as the "right delimiter character" and the program branches to diamond 111.

In diamond 111, a decision is made as to whether or not this right delimiter character is the letter "L". If it is, box 112 is entered and a hexidecimal '80' is added to the hexidecimal representation of the ASCII code for an "L" (hex. '9C'). The result of this addition is a hexidecimal 'CC' which, referring to Table 2, is in a font for displaying the letter "L" in which the "L" representation is 4 columns wide and shifted to the right. The hexidecimal 'CC' is stored in the second data base as the appropriate modified ASCII code for this character "L" and box 113 is entered. In box 113, the memory location of the character prceding the right delimiter character is saved for future reference. This character is defined as the "last block character".

Returning to the diamond 111, if the analysis indicates that the right delimiter character is not the letter "L", diamond 114 is entered where a decision is made as to whether the right delimiter character is the letter "J". If it is not the letter "J", box 113 is entered and the above-described operation is performed. If, on the other hand, it is the letter "J", a hexidecimal '50' is added to the hexidecimal representation of the ASCII encoding for the letter "J" (hex. '4A') and the resulting hexidecimal '9A' is stored in the second data base. (See Table 2 for significance of this encoding). Box 113 is then entered.

The result of the steps just described is to determine a block of characters starting with the "first block character" which is not a limiter character and ending with the "last block character" immediately before the next delimiter character. The system then proceeds to examine the characters in that block and to replace certain ASCII code representations of letters with alternative codes to cause the letters to be 4 columns wide and shifted to the right or left of the array. This is now shown.

From box 113, the program proceeds to box 116 (see FIG. 3B) where it returns to examine the "first block character". In box 117, the ASCII code for this character is compared with the ASCII codes of a group of characters which are defined as "wide" characters. As set forth in box 118 the characters which are "wide" characters in the illustrative embodiment of the invention are "M", "N", "V", "W", "X", "Y" and "Z". In box 119, a decision is made as to whether the character being examined is in fact a wide character.

If the character currently being analyzed is not a "wide" character, diamond 124 is entered where a decision is made as to whether the character is the last character of the character block. If it is not, box 125 is entered and the program proceeds to examine the next character in the character block. The program returns to box 117 to proceed with the analysis of this character. In this way, by analyzing successive characters until a "yes" is obtained in diamond 119, the system locates the first wide chracter, which becomes a "primary character".

Upon identifying a wide character in diamond 119, box 120 is entered. In box 120, a hexidecimal '50' is added to the hexidecimal representations of all of the characters within the character block under consideration wich are to the left of the primary ("wide") character. It should be noted at this point that since delimiter characters are not included in a character block, all of the characters to the left of a wide character within a character block must be those of the type which are capable of being displayed either 5-wide, 4-wide shifted left, or 4-wide shifted right. The characters of all of these fonts are included in Table 2. Adding a hexidecimal '50' to the ASCII representation of a character (see left column of Table 2) will always result in the alternative hexidecimal coding of a character which denotes a four-column display representation shifted to the left (center column of Table 2). Similarly, adding a hexidecimal '80' to an ASCII code of a character will always result in an alternative hexidecimal coding of the character which denotes a display representation for that character which is four columns wide and shifted to the right (see rightmost column of Table 2).

The results of the operations in box 120 are appropriately stored in respective memory locations of the second data base. Box 121 is then entered where a hexidecimal '80' is added to the ASCII codes of all characters within the same character block to the right of the primary character. The results of the operations of box 121 are also appropriately stored in the second data base.

If there are not wide characters in the character block, a "yes" will not be derived from diamond 119 for any of the characters in the block. Returning to diamond 124, if the character under analysis is the "last block character", the program branches to box 126 (FIG. 3C). This is to select an alternate primary character, from the priority list set forth in box 127. In box 126, the program selects the first character from that priority list in box 127. The program then goes back to examine the "first block character" (see box 128 of FIG. 3C) and compares this character with the character selected from the priority list (block 129). In diamond 130, a decision is made as to whether the comparison of these two characters indicates that the characters are the same. If the characters are the same, box 131 is entered and the character from the block of characters is identified as a primary character. The program then branches to box 120 (FIG. 3B) and proceeds as previously described.

Returning to diamond 130, if the character selected from the character block is not the same as the character selected from the priority list, decision diamond 132 is entered. In diamond 132, a decision is made as to whether the character just analyzed was the "last block character". If it was not, the program proceeds to box 133 where the next character of the character block is retrieved. The program then loops back to box 129 to proceed with the analysis of that character. The program continues to examine successive characters of the block until some character is the same as the selected priority character, whereupon diamond 130 branches to box 131.

However, returning to decision diamond 132, if all block characters are examined without matching to the selected priority character, and the character analyzed in boxes 129 and 130 is the "last block character", decision diamond 134 is entered where a determination is made as to whether there are any characters remaining in the priority list which have not yet been compared with the character currently under analysis. If the last character in the priority list has not yet been reached, box 135 is entered and the next character in the priority list is selected for comparison sequentially with the characters in the character block under analysis. The program then moves back to block 128 and the first character in the block is compared with the selected priority character. The program then proceeds as described previously, to compare each block character with the next priority character. This operation proceeds until either a match is obtained, or all block characters have been compared with all priority characters without a match.

Returning a decision diamond 134, when the last character in the priority list has been compared with all the characters in the character block under analysis, without a match, the program loops back to diamond 122 where a decision is made as to whether there as any more characters in the line. If there are no more characters in the line, the program ends, as indicated at 138, until another message line is called up for analysis.

However, if a match has been made so that a primary character has been located in the character block, after the completion of the operation in box 121, diamond 122 is entered where a determination is made as to whether there are any more characters remaining in the message line currently under analysis. If characters do remain in the message line, a search for a new character block is commenced by first analyzing the first character to the right of the right delimiter character (see box 123). From bos 123, the program loops back to box 102 (FIG. 3A) and conitinues with analysis as described above.

In this way, for each block of characters between the narrow delimiter characters, a primary character is determined which is caused to be displayed in full width. The block characters to the left of the primary character are caused to be displayed in intermediate width and shifted left. The block characters to the right of the primary character are caused to be displayed with intermediate width and shifted right, except for wide characters, which are always displayed in full width. The delimiter characters are displayed without shifting.

Set forth below, is a program listing of a presently preferred embodiment of the program of FIGS. 3A–3C which is programmed in Z-80 code for execution on a Radio Shack TRS-80 Mod [4] II computer. The following symbolic names are used in this program.

PARAM 1—Length the line to be converted

PARAM 2—Least significant byte of address of first character in line to be converted PARAM 3—Most significant byte of address of first character in line to be converted

| NARROW = TABLE OF DELIMITER CHARACTERS | | | |
|---|---|---|---|
| [space] | ' | 1 | J |
| ! | – | : | L |
| % | . | ; | T |

-continued

| NARROW = TABLE OF DELIMITER CHARACTERS | | | |
|---|---|---|---|
| ' | / | I | — |
| + | | | |

PARAM 5—Least significant byte of address of first block character

PARAM 6—Most significant byte of address of first block character

PARAM 4—Length of current block

PARAM 7—Number of characters in block to be shifted left

PARAM 8—Address of character following wide character

PARAM 9—Same as Param 8

PARAM 10—Number of characters to be shifted right

PARAM 11—Number of characters left in line (intermediate result)

| WIDE - TABLE OF "WIDE" CHARACTER | |
|---|---|
| M | X |
| N | Y |
| V | Z |
| W | |
| PRIOR - PRIORITY LIST (in order of priority) | |
| R K B D P G S A Q O U C H E F 3 2 4 5 6 9 7 8 0 | |

As used herein, the term "display representation" for any character means the set of signals which cause the individual display elements 3 to be actuated so that the character is displayed on the display module. It will be understood that in some instances several modified ASCII codes may provide the same display representation (e.g. the ASC11 code for "M", and the modified ASCII code for "M" provide the same display representation by which the full width of the character display space is used to display "M"). In other instances, each code may provide a unique character display (e.g., for "L", where the original ASCII code provides a 5-column display, while the modified codes, formed by adding "50" or "80" to the ASCII code, provide a left-shifted or right-shifted 4-column display).

It will be understood that each message stored in memory 6 in ASCII code is in the way described above converted into a modified message, in a modified ASCII code or font, in wich certain characters (e.g. delimiter characters and wide characters) are encoded to produce the same display as provided by their original ASCII representations, and others are encoded in modified ASCII representations, which produce a displayed character which is to be shifted in its display to the left or to the right. These modifed messages are then used to actuate the display in the same manner as in the prior LIDS-4 system referred to above.

In actuating the display in response to the encoded character representations, by means of the display interface 7, the delimiter characters and wide characters are displayed centered on their display spaces. The other characters are displayed shifted left or right by one column, so as to be left-adjusted or right-adjusted, in accordance with the modification of their ASCII codes by the addition of 50 or 80 as the case may be. The result is that narrower letters are spaced from the wider ones in a way which enhances the legibility of the displayed message.

Thus, in accordance with the present invention, each time a message is selected for display, the ASCII-coded representations for that message, as stored in memory 6, is examined and the individual character representations are modified into new representations suitable for actuating the display to provide improved legibility for the displayed message.

Said program is as follows:

```
ADDR   OBJECT     ST # SOURCE STMT

                  0001 *        M600.SRC
                  0002 *
                  0003 *        Z80 ASSEMBLY LANGUAGE PROGRAM
                  0004 *
                  0005 *        07/13/84
                  0006 *
>2800             0007          ORG     02800H
>2800             0008 PARAM1   EQU     02800H
>2801             0009 PARAM2   EQU     02801H
>2802             0010 PARAM3   EQU     02802H
>2803             0011 PARAM4   EQU     02803H
>2804             0012 PARAM5   EQU     02804H
>2805             0013 PARAM6   EQU     02805H
>2806             0014 PARAM7   EQU     02806H
>2807             0015 PARAM8   EQU     02807H
>2808             0016 PARAM9   EQU     02808H
>2809             0017 PARA10   EQU     02809H
>280A             0018 PARA11   EQU     0280AH
>2810             0019          ORG     02810H
                  0020 *        DISABLE BREAK KEY
>2820             0021          ORG     02820H
                  0022 *ARCV    CHANNEL A RECEIVE
```

```
'2820  3E60      0023          LD       A,96
'2822  CF        0024          RST      8
'2823  320028    0025          LD       (PARAM1),A
'2826  78        0026          LD       A,B
'2827  320128    0027          LD       (PARAM2),A
'282A  C9        0028          RET
 >2830           0029          ORG      02830H
                 0030 *ATX     CHANNEL A TRANSMIT
'2830  3A0028    0031          LD       A,(PARAM1)
'2833  47        0032          LD       B,A
'2834  3E61      0033          LD       A,97
'2836  CF        0034          RST      8
'2837  320028    0035          LD       (PARAM1),A
'283A  C9        0036          RET
 >2840           0037          ORG      02840H
                 0038 *ACTRL   CHANNEL A CONTROL
'2840  3A0028    0039          LD       A,(PARAM1)
'2843  47        0040          LD       B,A
'2844  3E64      0041          LD       A,100
'2846  CF        0042          RST      8
'2847  78        0043          LD       A,B
'2848  320028    0044          LD       (PARAM1),A
'284B  C9        0045          RET
 >2850           0046          ORG      02850H
                 0047 *        CHECK SUM SUBROUTINE
'2850  0644      0048          LD       B,044H
'2852  0E00      0049          LD       C,0
'2854  2A0028    0050          LD       HL,(PARAM1)
'2857  7E        0051 TH99     LD       A,(HL)
'2858  FE40      0052          CP       040H
'285A  FA5F28'   0053          JP       M,TH98
'285D  C6C9      0054          ADD      A,0C9H
'285F  07        0055 TH98     RLCA
'2860  07        0056          RLCA
'2861  07        0057          RLCA
'2862  07        0058          RLCA
'2863  E6F0      0059          AND      0F0H
'2865  81        0060          ADD      A,C
'2866  4F        0061          LD       C,A
'2867  23        0062          INC      HL
'2868  7E        0063          LD       A,(HL)
'2869  FE40      0064          CP       040H
'286B  FA7028'   0065          JP       M,TH101
'286E  C6C9      0066          ADD      A,0C9H
'2870  E60F      0067 TH101    AND      0FH
'2872  81        0068          ADD      A,C
'2873  4F        0069          LD       C,A
'2874  23        0070          INC      HL
'2875  10E0      0071          DJNZ     TH99
'2877  EEFF      0072          XOR      0FFH
'2879  3C        0073          INC      A
'287A  4F        0074          LD       C,A
'287B  0F        0075          RRCA
'287C  0F        0076          RRCA
'287D  0F        0077          RRCA
'287E  0F        0078          RRCA
'287F  E60F      0079          AND      0FH
```

```
'2881  C630      0080          ADD     A,030H
'2883  FE3A      0081          CP      03AH
'2885  FA8A28'   0082          JP      M,TH100
'2888  C607      0083          ADD     A,07
'288A  77        0084 TH100    LD      (HL),A
'288B  23        0085          INC     HL
'288C  79        0086          LD      A,C
'288D  E60F      0087          AND     0FH
'288F  C630      0088          ADD     A,030H
'2891  FE3A      0089          CP      03AH
'2893  FA9828'   0090          JP      M,TH102
'2896  C607      0091          ADD     A,07
'2898  77        0092 TH102    LD      (HL),A
'2899  C9        0093          RET
 >28A0           0094          ORG     028A0H
                 0095 *        VARIABLE FONT ROUTINE
'28A0  2A0028    0096          LD      HL,(PARAM1)
'28A3  7E        0097          LD      A,(HL)
'28A4  320028    0098          LD      (PARAM1),A
'28A7  23        0099          INC     HL
'28A8  7E        0100          LD      A,(HL)
'28A9  320128    0101          LD      (PARAM2),A
'28AC  23        0102          INC     HL
'28AD  7E        0103          LD      A,(HL)
'28AE  320228    0104          LD      (PARAM3),A
'28B1  3A0028    0105 MD       LD      A,(PARAM1)
'28B4  FE00      0106          CP      0H
'28B6  2826      0107          JR      Z,MD1
'28B8  4F        0108          LD      C,A
'28B9  ED5B0128  0109          LD      DE,(PARAM2)
'28BD  0611      0110 MD2      LD      B,011H
'28BF  21AE29'   0111          LD      HL,NARROW
'28C2  1A        0112          LD      A,(DE)
'28C3  BE        0113 MD3      CP      (HL)
'28C4  280D      0114          JR      Z,MD4
'28C6  23        0115          INC     HL
'28C7  10FA      0116          DJNZ    MD3
'28C9  ED530428  0117          LD      (PARAM5),DE
'28CD  79        0118          LD      A,C
'28CE  320A28    0119          LD      (PARA11),A
'28D1  1818      0120          JR      MD5
'28D3  FE4A      0121 MD4      CP      04AH
'28D5  2003      0122          JR      NZ,MD6
'28D7  C650      0123          ADD     A,050H
'28D9  12        0124          LD      (DE),A
'28DA  13        0125 MD6      INC     DE
'28DB  0D        0126          DEC     C
'28DC  20DF      0127          JR      NZ,MD2
'28DE  C9        0128 MD1      RET
'28DF  0611      0129 MD7      LD      B,011H
'28E1  21AE29'   0130          LD      HL,NARROW
'28E4  1A        0131          LD      A,(DE)
'28E5  BE        0132 MD8      CP      (HL)
'28E6  2814      0133          JR      Z,MD9
'28E8  23        0134          INC     HL
'28E9  10FA      0135          DJNZ    MD8
'28EB  13        0136 MD5      INC     DE
```

```
'28EC  0D        0137        DEC   C
'28ED  20F0      0138        JR    NZ,MD7
'28EF  79        0139        LD    A,C
'28F0  320028    0140        LD    (PARAM1),A
'28F3  3A0A28    0141        LD    A,(PARA11)
'28F6  91        0142        SUB   C
'28F7  320328    0143        LD    (PARAM4),A
'28FA  1821      0144        JR    MC
'28FC  FE4C      0145 MD9    CP    04CH
'28FE  2005      0146        JR    NZ,MD11
'2900  C680      0147        ADD   A,080H
'2902  12        0148        LD    (DE),A
'2903  1807      0149        JR    MD10
'2905  FE4A      0150 MD11   CP    04AH
'2907  2003      0151        JR    NZ,MD10
'2909  C650      0152        ADD   A,050H
'290B  12        0153        LD    (DE),A
'290C  3A0A28    0154 MD10   LD    A,(PARA11)
'290F  91        0155        SUB   C
'2910  320328    0156        LD    (PARAM4),A
'2913  13        0157        INC   DE
'2914  0D        0158        DEC   C
'2915  ED530128  0159        LD    (PARAM2),DE
'2919  79        0160        LD    A,C
'291A  320028    0161        LD    (PARAM1),A
'291D  3A0328    0162 MC     LD    A,(PARAM4)
'2920  4F        0163        LD    C,A
'2921  ED5B0428  0164        LD    DE,(PARAM5)
'2925  0607      0165 MC1    LD    B,07H
'2927  21BF29'   0166        LD    HL,WIDE
'292A  1A        0167        LD    A,(DE)
'292B  BE        0168 MC2    CP    (HL)
'292C  2821      0169        JR    Z,MC3
'292E  23        0170        INC   HL
'292F  10FA      0171        DJNZ  MC2
'2931  13        0172        INC   DE
'2932  0D        0173        DEC   C
'2933  20F0      0174        JR    NZ,MC1
'2935  0E18      0175        LD    C,018H
'2937  11C629'   0176        LD    DE,PRIOR
'293A  3A0328    0177 MC4    LD    A,(PARAM4)
'293D  47        0178        LD    B,A
'293E  2A0428    0179        LD    HL,(PARAM5)
'2941  1A        0180        LD    A,(DE)
'2942  BE        0181 MC5    CP    (HL)
'2943  281D      0182        JR    Z,MC6
'2945  23        0183        INC   HL
'2946  10FA      0184        DJNZ  MC5
'2948  13        0185        INC   DE
'2949  0D        0186        DEC   C
'294A  20EE      0187        JR    NZ,MC4
'294C  C3B128'   0188        JP    MD
'294F  3A0328    0189 MC3    LD    A,(PARAM4)
'2952  91        0190        SUB   C
'2953  320628    0191        LD    (PARAM7),A
'2956  13        0192        INC   DE
```

```
'2957  0D          0193          DEC     C
'2958  79          0194          LD      A,C
'2959  320928      0195          LD      (PARA10),A
'295C  ED530728    0196          LD      (PARAM8),DE
'2960  1810        0197          JR      MA
'2962  3A0328      0198  MC6     LD      A,(PARAM4)
'2965  90          0199          SUB     B
'2966  320628      0200          LD      (PARAM7),A
'2969  23          0201          INC     HL
'296A  05          0202          DEC     B
'296B  78          0203          LD      A,B
'296C  320928      0204          LD      (PARA10),A
'296F  220728      0205          LD      (PARAM8),HL
'2972  3A0628      0206  MA      LD      A,(PARAM7)
'2975  FE00        0207          CP      0H
'2977  2815        0208          JR      Z,MB
'2979  47          0209          LD      B,A
'297A  2A0428      0210          LD      HL,(PARAM5)
'297D  7E          0211  MA1     LD      A,(HL)
'297E  FE30        0212          CP      030H
'2980  FA8B29'     0213          JP      M,MA2
'2983  FE5C        0214          CP      05CH
'2985  F28B29'     0215          JP      P,MA2
'2988  C650        0216          ADD     A,050H
'298A  77          0217          LD      (HL),A
'298B  23          0218  MA2     INC     HL
'298C  10EF        0219          DJNZ    MA1
'298E  3A0928      0220  MB      LD      A,(PARA10)
'2991  FE00        0221          CP      0H
'2993  CAB128'     0222          JP      Z,MD
'2996  47          0223          LD      B,A
'2997  2A0728      0224          LD      HL,(PARAM8)
'299A  7E          0225  MB1     LD      A,(HL)
'299B  FE30        0226          CP      030H
'299D  FAA829'     0227          JP      M,MB2
'29A0  FE5C        0228          CP      05CH
'29A2  F2A829'     0229          JP      P,MB2
'29A5  C680        0230          ADD     A,080H
'29A7  77          0231          LD      (HL),A
'29A8  23          0232  MB2     INC     HL
'29A9  10EF        0233          DJNZ    MB1
'29AB  C3B128'     0234          JP      MD
'29AE  20212527    0235  NARROW  DEFM    ' !%''+,-./1:;IJLT<'
       2B2C2D2E
       2F313A3B
       494A4C54
       5F
'29BF  4D4E5657    0236  WIDE    DEFM    'MNVWXYZ'
       58595A
'29C6  524B4244    0237  PRIOR   DEFM    'RKBDPGSAQOUC'
       50475341
       514F5543
'29D2  48454633    0238          DEFM    'HEF324569780'
       32343536
       39373830
                   0239          END
```

What is claimed is:

1. A method of providing improved legibility for display of a sequence of characters, wherein in said display, all characters are displayed in equal sized display spaces, aid characters including narrower, wider and intermediate-width characters, said method comprising the steps of dividing said sequence of characters into one or more blocks of characters, said blocks being separated by one or more narrower characters, displaying said wider characters of each said block in their respective display spaces in a width equal to said display space, identifying in each block a primary wider character, displaying said intermediate-width characters of each block in their display spaces with widths less than their respective display spaces, said intermediate-width characters of any block which are to the left of the primary character of their block being displayed off-center and shifted to the left in their display spaces.

2. A method as in claim 1 further including the steps of:

displaying those of said intermediate-width characters within any block which are to the right of said primary character of said respective block off center and shifted to the right in their respective display spaces.

3. A method as in claim 1 further including the step of displaying said narrower characters substantially centered in their respective display spaces.

4. A method as in claim 1 wherein said primary character is a wider character.

5. A method as in claim 1 wherein said primary character of each character block is the left-most character in said block corresponding to a character of an ordered character list.

6. A method as in claim 1 further including the step of selecting said primary character as the earliest appearing character of an ordered list of characters.

7. A method of modifying the coding of a sequence of ASCII-coded characters intended for display in an array of character display spaces all of equal width in order to improve legibility of said character sequence, comprising the steps of selecting one character of said sequence as a primary character, modifying in one way the codes of characters in said sequence to the left of said primary character, and modifying in a different way the codes of characters in said sequence to the right of said primary character so that when displayed, said complete sequence will have improved legibility as compared with said sequence without said modification.

8. A method as in claim 6 wherein said firstmodifying comprises adding a fixed hexadecimal number to the hexadecimal number representing each of said left characters, and adding a different fixed hexadecimal number to the hexadecimal number representing each of said right characters.

9. A method as in claim 6 further including the steps of utilizing said first-mentioned modified codes to display said left characters only partially filling their respective display spaces and shifted to the left in their display spaces.

10. A method as in claim 6 further including the steps of utilizing said second-mentioned modified codes to display at least some of said right characters only partially filling their respective display spaces and shifted to the right in their display spaces.

11. A method for providing variable spacing between characters displayed in a line of character display spaces of equal width comprising the steps of selecting a group of wide characters for display using corresponding display representations having the same width as the character display spaces, selecting a second group of characters each of which may be represented by a respective first display representation which is narrower than character display space and displayable left-adjusted in its respective character display space or represented by a second display representation which is narrower than the character display space and is displayable right-adjusted in its respective character space;

organizing each line of characters into character blocks containing only characters of said wide character group and said second character group;

identifying the left-most character of said wide group in each said block;

displaying each character to the left of the left-most wide character in its block using its left-adjusted representation;

displaying each character in said second character group to the right of the left-most wide character using its right-adjusted representation.

12. A method of displaying messages in a display system including a plurality of display spaces of equal width, each said display space being adapted to display a single representation of a character therein, said display spaces being arranged in at least one line of side-by-side display spaces, each of said messages comprising a sequence of characters, certain of said characters being wide characters each equal in width to said display spaces, and others of said characters having a width less than said display spaces, said method comprising the steps of organizing the characters in said sequence into one or more character blocks, each of said blocks consisting of wide characters and/or lesser-width characters;

identifying a leftmost wide character in each said block;

selecting a display representation for said leftmost wide character having a width equal to that of its corresponding display space;

displaying said wide characte with a width equal to said display space;

selecting a correponding left-adjusted display representation for each character in said block to the left of said leftmost wide character, and displaying each said corresponding representation in a width narrower than its corresponding display space and left-adjusted therein.

13. The method of claim 11 further comprising:

selecting a corresponding right-adjusted display representation for each character in said block to the right of said leftmost wide character, and displaying each said corresponding right-adjusted display representation in width less than its respective display space and right-adjusted therein.

14. The method of claim 11 wherein said first selecting step includes the step of:

storing an ASCII code for said leftmost wide character in a message memory means at a location corresponding to the position of said leftmost character in the message.

15. The method of claim 11 wherein said second selecting step includes:

modifying an ASCII code corresponding to each said character to the left of said leftmost wide character; and storing each of said modified codes in a message memory means at a location corresponding to the position of the corresponding character in its message.

16. The method of claim 12 wherein said step of selecting a corresponding right adjusted display representation includes the steps of modifying an ASCII code corresponding to each said character to the right of said leftmost wide character; and storing each of the modified codes obtained in the previous step in a message memory means at a location corresponding to the position of the corresponding character in the message.

17. A method in accordance with claim 14 wherein said modifying step comprises adding a predetermined hexidecimal value to the hexidecimal equivalent of said corresponding ASCII code.

18. The method of claim 16 wherein said adding step comprises adding a first predetermined hexidecimal number to the hexidecimal equivalent of said corresponding ASCII code for selecting a left adjusted corresponding display representation and adding a second predetermined hexidecimal number to the hexidecimal equivalent of said corresponding ASCII code for selecting a right-adjusted corresponding display representation.

19. The method of claim 17 wherein said first hexidecimal number is '50' and said second hexidecimal number is '80'.

20. The method of claim 14 wherein said storing step comprises storing the modified ASCII codes in a programmable read only memory.

21. The method of claim 14 further comprising translating each modified ASCII code stored in the previous step into a corresponding display representation.

22. The method of claim 20 wherein said display representation are signals representing a pattern of dots.

23. A system for displaying messages having a plurality of characters comprising a plurality of display modules arranged in at least one line, each module providing a display space adapted to display one of said characters and al said display spaces being of equal width;

means for storing data representing character representations taken from a first font or a second font of character representations, wherein the width of at least one character representation of said first font for a character is different from the character representation of said second font for the same character;

means for selecting a message to be displayed;

means responsive to said selecting means for reading data from said storing means corresponding to each character to be displayed in one or the other of said fonts;

means responsive to the data read from said storing means for displaying each said character representation in a corresponding display space.

24. The system of claim 22 wherein said selecting means includes means for storing encoded data defining a plurality of said characters, said encoded data including data for providing a display representation of the character to be displayed in one or the other of said fonts.

25. The system of claim 22 including means for providing at least one display representation for producing a displayed character which is narrower than the width of a display space and displayable left-adjusted withon one said display space and means for providing a display representation corresponding to and having the same width as a said display space, said second display representation producing a character being displayable right adjusted within one said display space.

26. The system of claim 22 wherein said selecting means comprises means for selecting characters to be displayed;

a microprocessor including program means responsive to said selecting means for generating encoded data specifying the character space in which each display representation is to be displayed and the font in which each character display representation is included.

27. A system for providing improved legibility for a display formed of a sequence of characters, including narrower, wider and intermediate-width characters, wherein said system provides equal display space for all characters without reference to said character widths, comprising means for dividing said sequence of characters into one or more blocks of wider and intermediate-width characters separated by narrower characters, means for causing each of said wider characters to be displayed in its respective display space with a width equal to its display space, means selecting a primary character in each block, means for causing each of said intermediate-width characters which is to one side of said primary character to be displayed in its respective display space off-center and shifted to said one side in its display space.

28. A system as in claim 26 wherein said one side is the left side.

29. A system as in claim 26 wherein said one side is the right side.

30. A system as in claim 26 further including means for causing each of said intermediate-width characters which is on either side of said primary character to be displayed in its respective display space off-center and shifted to the respective side.

31. A system as in claim 26 wherein said primary character is a wider character.

32. A system as in claim 26 wherein said primary character is an intermediate-width character which is a character of said sequence appearing earliest on an ordered list of characters.

* * * * *